US010677546B1

(12) United States Patent
Tharp et al.

(10) Patent No.: US 10,677,546 B1
(45) Date of Patent: Jun. 9, 2020

(54) SEMI-AUTOMATIC SHOTGUN WITH BOTTOM EJECTING PORT

(71) Applicants: William Tharp, Hamilton, VA (US); Jason Bourland, Purcellville, VA (US); Nathan Hensley, Middleburg, VA (US)

(72) Inventors: William Tharp, Hamilton, VA (US); Jason Bourland, Purcellville, VA (US); Nathan Hensley, Middleburg, VA (US)

(73) Assignee: Monsters Forge, LLC, Hamilton, VA (US)

( * ) Notice: Subject to any disclaimer, the term of this patent is extended or adjusted under 35 U.S.C. 154(b) by 0 days.

(21) Appl. No.: 16/427,784

(22) Filed: May 31, 2019

(51) Int. Cl.

| | |
|---|---|
| ***F41A 9/41*** | (2006.01) |
| ***F41A 3/40*** | (2006.01) |
| ***F41A 9/72*** | (2006.01) |
| *F41A 17/54* | (2006.01) |

(52) U.S. Cl.
CPC ..... *F41A 3/40* (2013.01); *F41A 9/72* (2013.01); *F41A 17/54* (2013.01)

(58) Field of Classification Search
CPC ..... F41A 3/40; F41A 3/38; F41A 3/12; F41A 9/72; F41C 7/02
See application file for complete search history.

(56) References Cited

U.S. PATENT DOCUMENTS

| | | | | |
|---|---|---|---|---|
| 4,821,442 | A * | 4/1989 | Bock | F41A 9/72 42/17 |
| 9,400,149 | B2 * | 7/2016 | Potter | F41A 9/48 |
| 2020/0025499 | A1 * | 1/2020 | Berean | F41A 21/36 |

* cited by examiner

*Primary Examiner* — J. Woodrow Eldred
(74) *Attorney, Agent, or Firm* — Attentive Law; Paul Ratcliffe

(57) ABSTRACT

A shell feeding system for a top loading shotgun in one embodiment includes a barrel, receiver, and a magazine. The magazine includes a cavity configured to receive a plurality of ammunition shells in stacked end-to-end relationship. The magazine is positioned above the barrel and extends forward from the receiver. A load gating and locking block engages and guide each shell in a feed pathway towards the lower part of the receiver for chambering. In one embodiment, the receiver and magazine may be formed as a unitary integral structure forming a single piece.

13 Claims, 22 Drawing Sheets

SEMI-AUTOMATIC SHOTGUN WITH BOTTOM EJECTING PORT

FIELD OF THE INVENTION

The present invention relates generally to firearms and, in particular, to a shotgun with an improved shell loading, feed, and ejection system.

BACKGROUND OF THE INVENTION

Various types of arrangements are used for storing, feeding and ejecting shells into and from the chamber of a shotgun. Typical shotguns have tubular-shaped magazines mounted below the barrel which hold the shells in an end-to-end relationship. The shells are typically biased to feed the shell into the chamber during a pump action or some auto-loading feed mechanism. Once the shell is loaded into the chamber the chamber or breech is closed and the shotgun is ready to be fired using a trigger-actuated fire control mechanism. After firing, the spent shells are ejected through an external port from the re-opened chamber or breech. The next shell in the magazine may then be loaded into the chamber. However, an improved shell feeding, firing, and ejection system is desired.

SUMMARY OF INVENTION

The present invention provides a unique ammunition shell feeding system, firing system, and shell ejection system for a shotgun.

The improved shotgun provides a top loading configuration having the magazine positioned above the barrel. A top loading port works with a load gate to allow shells to be manually inserted into the magazine. The shells are biased by a spring-loaded element disposed in the magazine which biases the shells towards the chamber.

In one embodiment, a shell feeding system for a top loading shotgun includes a barrel defining a longitudinal axis and an axially extending bore forming a projectile pathway, a receiver supporting the barrel, and an elongated magazine positioned above the barrel and extending axially forward from the receiver. The magazine includes an axially extending cavity configured to receive a plurality of ammunition shells in stacked end-to-end relationship; the shells each having a head and diametrically enlarged rim. A top loading port is provided for loading shells into the magazine. After the shell stop and interrupter release the shell from the magazine, the load gate mechanism guides the shell downward into the central portion of the receiver. Once in the receiver, the bolt assembly pushes the shell forward from the central portion of the receiver into or towards the barrel.

A method for loading ammunition into a top loading shotgun is provided. The method includes: providing a shotgun including a receiver having load gate, a locking block, a barrel coupled to the receiver, and a magazine having a tubular body configured to hold a stack of shells arranged in end-to-end relationship, the magazine arranged above the barrel and having a spring-biased follower for urging the stack rearwards toward an open end of the magazine; loading a shell into the magazine in a horizontal position, the shell having a head defining a leading end and a case defining a trailing end; feeding the shell with the leading end first from the magazine rearward into an entrance portion of the load gate in the receiver; pushing the shell downwards into a first angled position, the leading end being lower than the trailing end, moving the shell from the entrance portion into a central portion of the receiver, while the shell interrupter prevents the following shell from being pushed down into the central portion; the load gate pushes the shell into a horizontal position; the load gate moving the shell downwards into a lower portion of the receiver, and the bolt pushing the shell into the barrel.

The present invention includes a locking block which works to lock the bolt from moving in a rearward direction when the lock is engaged upon the locking block being moved, through the operation rods or op rods, the bolt is unlocked and allowed to move in a rearward position. The bolt is designed to engage the load gate to raise the load gate allowing a shell, biased towards the load gate, to load into the chamber. The bolt has additional design elements enabling the load gate to lower the shell into the chamber. Once the shell is loaded into the chamber, the load gate is in a closed position allowing the bolt to move the shell into the chamber or a fire ready position for the striker to fire the shell. In the present invention, the load gate is biased to provide a force or bias on the shells in a downward direction to push shells into the receiver for the bolt to load the shell into the chamber. In contrast, typical load gates on known shotguns bias in a lifting or upward direction.

Another aspect of the present invention is the load gate and bolt assembly specifically, that the bolt is designed with ramps, grooves, or alignment paths to engage load gate protrusions or legs. These legs move along the bolt ramps or paths to force the load gate to raise or lower as the bolt moves. The bolt has front and rear ramps and may have one or more ramps on the front and rear of the bolt. Thus, the present invention provides a load gate that is moved, or its position is modified in related to the position of the bolt.

Another aspect of the present invention is the locking block design which is designed as part of the receiver. This unique locking block design allows the locking block to work independently of the bolt and is acted upon by the op rod to unlock the locking block. The locking block travels in a vertical movement as it moves from an unlocked to a locked position as facilitated by operating rods. As the op rods engage a lower portion of the locking block, the locking block moves in an upward direction to unlock the bolt. The locking block has nothing above the block to engage. Spring tension in a downward bias the locks the locking block into place.

The present invention also provides a striker fired shotgun. A striker tray is configured to interact with the bolt to lock the striker to the bolt. The striker tray of the present invention provides or is configured as a bottom guide mounted or connected to the bottom of the bolt rather than a typical rear guide. The tray retains the striker, preventing it from going too far back or moving down.

In one embodiment, barrel length and ammo length can be separate to allow for the modularity of the barrel. This allows for the extension of range of the projectile and the maximization of ammo held.

In an exemplary embodiment, the present invention provides a shotgun, the shotgun comprising: a barrel defining a longitudinal axis and an axially extending bore forming a projectile pathway; a receiver supporting the barrel; an elongated magazine positioned above the barrel and extending axially forward from the receiver; the magazine including an axially extending cavity configured to receive a plurality of ammunition shells in stacked end-to-end relationship, the shells each having a head and diametrically enlarged rim; a top loading port for loading shells into the magazine; a bolt with at least one guide path, wherein the at least one guide path has at least one design; a load gate having at least one protrusion, wherein the at least one protrusion moves along the at least one guide path causing the load gate to open and close based on the at least one design in the path, and wherein as the bolt moves in a first direction the load gate rises to allow a shell from the magazine to enter the receiver. The design of the guide path may be a descending ramp or an ascending ramp. The design of the guide path may include both a descending ramp and an ascending ramp. The bolt may have a first guide path and a second guide path. Further, the load gate may have a first protrusion for moving along the first guide path and a second protrusion for moving along the second guide path. The shotgun may further comprise a locking block for preventing movement of the bolt in the first direction when locked. The locking block may be unlocked by an operation rod. Further, the shotgun may include a striker for striking a shell in the chamber or barrel.

In an additional embodiment, the present invention provides a shotgun comprising: a barrel defining a longitudinal axis and an axially extending bore forming a projectile pathway; a receiver supporting the barrel; an elongated magazine positioned above the barrel and extending axially forward from the receiver; the magazine including an axially extending cavity configured to receive a plurality of ammunition shells in stacked end-to-end relationship, the shells each having a head and diametrically enlarged rim; a top loading port for loading shells into the magazine; a bolt having a first guide path and a second guide path, wherein the first guide path and the second guide path each have an ascending ramp and each have a descending ramp; a load gate having a first protrusion and a second protrusion on a lower portion of the load gate, wherein the first protrusion moves along the first guide path and the second protrusion moves along the second guide path; wherein as the bolt moves in a first direction the load gate rises as the first protrusion and second protrusion ascend up the ascending ramps to allow a shell from the magazine to enter the receiver and the load gate closes as the first protrusion and second protrusion descend down the descending ramps. The shotgun may include a locking block for preventing movement of the bolt in a first or rearward direction when locked. The locking block can be unlocked by an operation rod. The shotgun may further include a striker for striking a shell in the barrel.

BRIEF DESCRIPTION OF THE DRAWINGS

The present invention can be more fully understood by reading the following detailed description together with the accompanying drawings, in which like reference indicators are used to designate like elements, and in which.

DETAILED DESCRIPTION OF EXEMPLARY EMBODIMENTS

Hereinafter, aspects of the methods and associated systems in accordance with various embodiments of the invention will be described. As used herein, any term in the singular may be interpreted to be in the plural, and alternatively, any term in the plural may be interpreted to be in the singular. It is appreciated that features of one embodiment as described herein may be used in conjunction with other embodiments. The present invention can be more fully understood by reading the following detailed description together with the accompanying drawings, in which like reference indicators are used to designate like elements.

Figure 1:
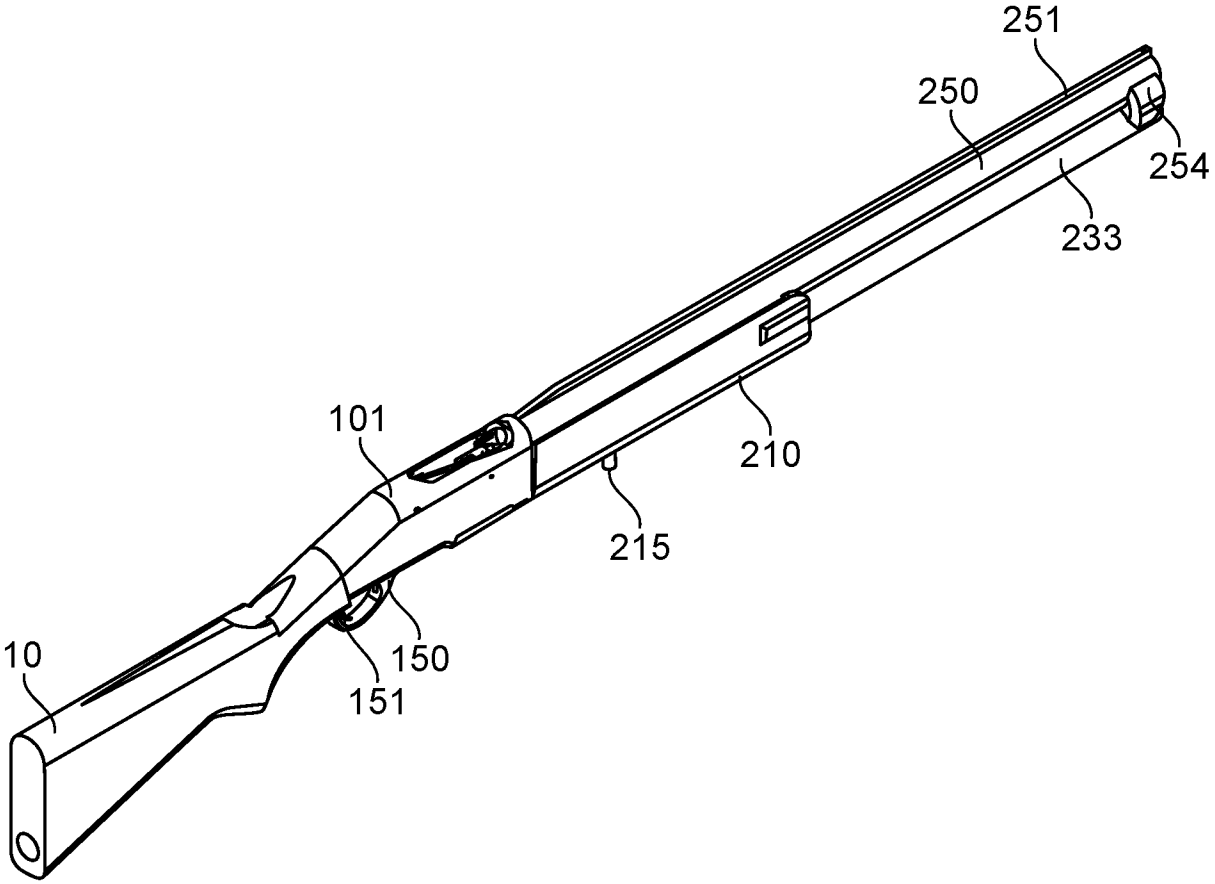
FIG. 1 provides a perspective view of the assembled semi-automatic shotgun of the present invention.

FIG. 1 shows an overview of the assembled automatic shotgun. The assembled shotgun has the stock 10, a receiver 101, a trigger guard 150, a trigger 151, a handguard 210, a charging handle track 215, a barrel 233, a magazine tube 250, a vent rib 251, and a magazine cap 254.

Figure 2:
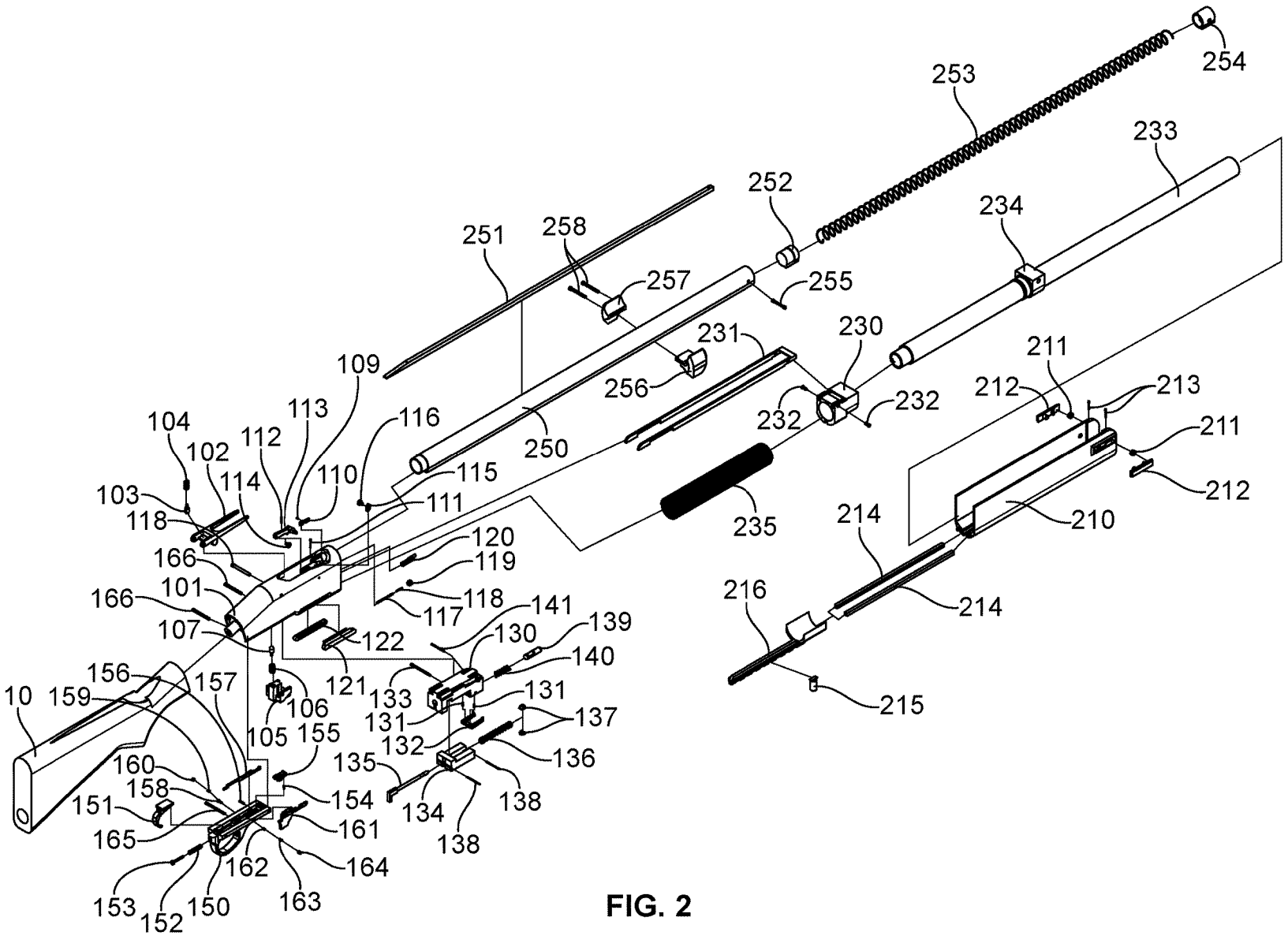
FIG. 2 depicts an exploded view of the semi-automatic shotgun of the present invention.

FIG. 2 shows an exploded view of the semi-automatic shotgun showing how all the pieces fit together. FIG. 2 with the following FIGS. 3-8 give a detailed breakdown of all the pieces of the semi-automatic shotgun. Overall, the shotgun stock 10 is connected to the receiver assembly 100. The trigger guard assembly 145 and the bolt assembly 125 nest into the receiver assembly 100. The receiver assembly 100 is further connected to the handguard assembly 200, barrel assembly 225, and magazine tube assembly 245. The exploded view shows all pieces of the shotgun and when assembled resembles FIG. 1.

Figure 3:
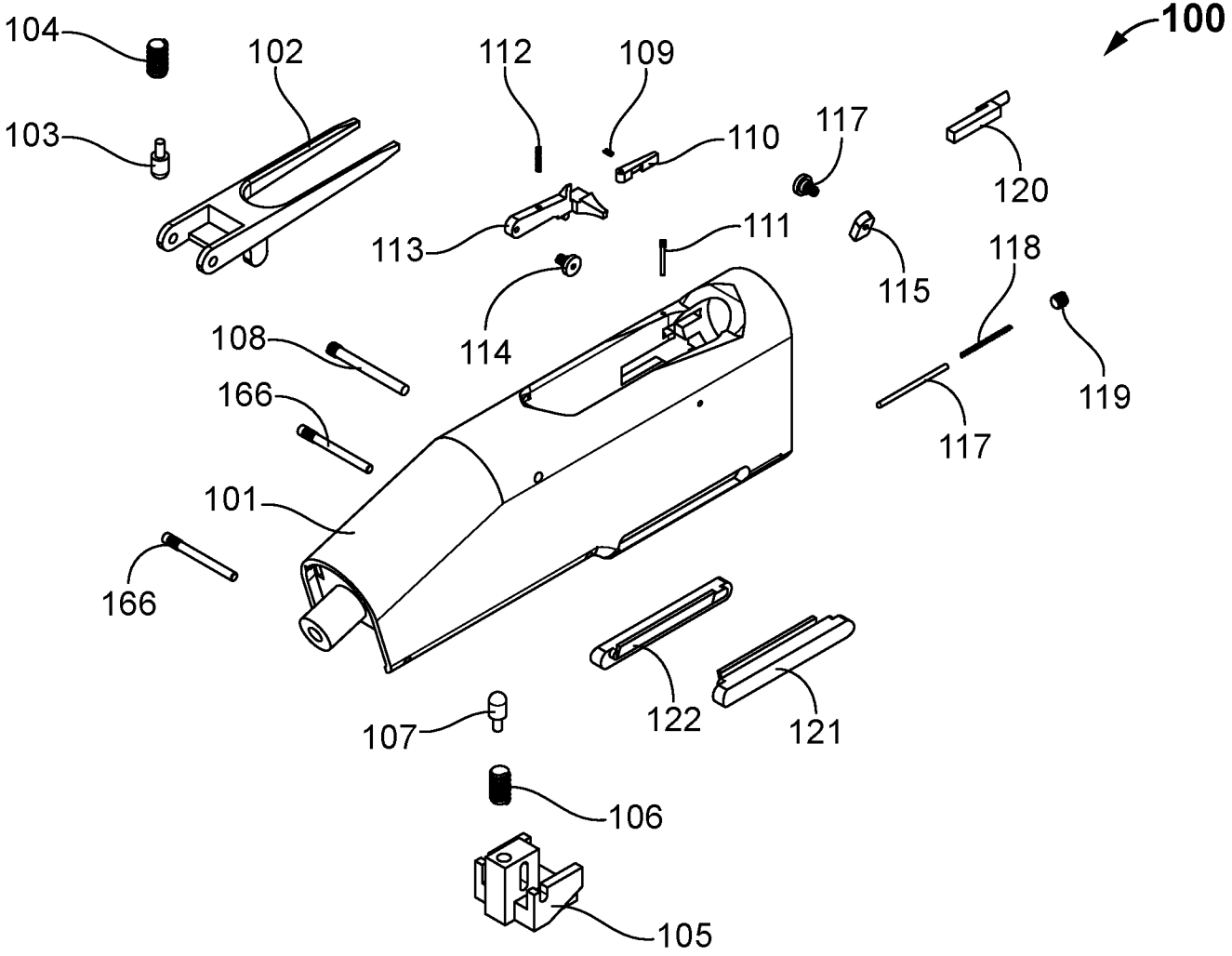
FIG. 3 depicts an exploded view of the receiver tube assembly of the present invention.

FIG. 3 shows the parts of the receiver assembly 100. The receiver assembly 100 is broadly composed of receiver 101, the load gate 102, the locking block 105, the shell interrupter 110, the shell stop 113, the bolt stop 115, and the load wings 120 and 121. The receiver 101 is the housing that all other parts are attached to the shotgun.

The receiver 101 holds the shell stop and interrupter which controls the feed of ammunition into and out of the magazine tube 250. The load gate 102 facilitates the round being aligned in front of the bolt 130 (FIG. 4) prior to being pushed into the chamber. In a typical embodiment of a shotgun the load gate works as a tray, with the standard load gate being located on the bottom of the shotgun, and it is always in an up position. The standard load gate uses a lift mechanism that is based on the movement of the operational rods.

In contrast, the load gate 102 of present invention uses a downward bias or push mechanism and the load gate 102 movement is directly related to the position of the bolt 130.

The load gate 102 has load gate rear shoulders on the rear of the load gate 102 to attach the load gate 102 to the locking block 105 by pin 108. The load gate 102 utilizes the load gate detent 103 and the load gate detent spring 104. The load gate detent 103 reduces friction and maintains a downward force on the load gate shelf. The load gate detent spring 104 applies force downward toward the load gate detent 103 and the load gate 102. The load gate 102 is secured to the receiver by the locking block pin 108. The locking block pin 108 also secures the locking block 105 to the receiver 101. The locking block 105 moves along a vertical track or direction relative to the bolt 130. The locking block 105 is biased or forced down into a bottom position to lock the bolt 130 from rearward travel and secure a round in battery. The locking block 105 has a lower portion 175 (see FIG. 17) with a forward locking end 176 for engaging a rearward edge 173 of the bolt 130. The blot is not allowed to move rearward when the locking end 176 of the locking block 105 is engaged with the rearward edge 173 of the bolt 130.

In a standard or typical shotgun design the locking block is built into and operated by the bolt. In the present invention, the locking block 105 operates off of movement by the operation rod 231 (see FIG. 7). The locking block 105 includes the locking block spring 106 and the locking block detent 107. The locking block spring 106 puts downward force on the locking block 105, and the locking block detent 107 reduces the friction on receiver interface.

The load gate 102 works in combination with shell stop 113, which stops rearward travel of shells out of the magazine tube 250. The shell stop 113 has a shell stop spring 112 and a shell stop screw 114. The shell stop spring 112 puts downward force on the shell stop 113, and the shell stop screw 114 is pan head screw that secures the shell stop 113 and allows it to pivot up and allow ammunition to leave the magazine tube 250. The shell stop 113 utilizes the shell interrupter 110, which temporarily stops ammunition as it exits the magazine tube 250. The shell interrupter 110 has a shell interrupter spring 109 that puts inward pressure on the shell interrupter 110, forcing the shell stop 113 down and preventing the rearward travel of the ammunition. The shell interrupter 110 is secured to the receiver 101 by the interrupter pin 111 which not only secures the interrupter 110 but allows the shell interrupter 110 to pivot and release the shell stop 113.

Figure 4:
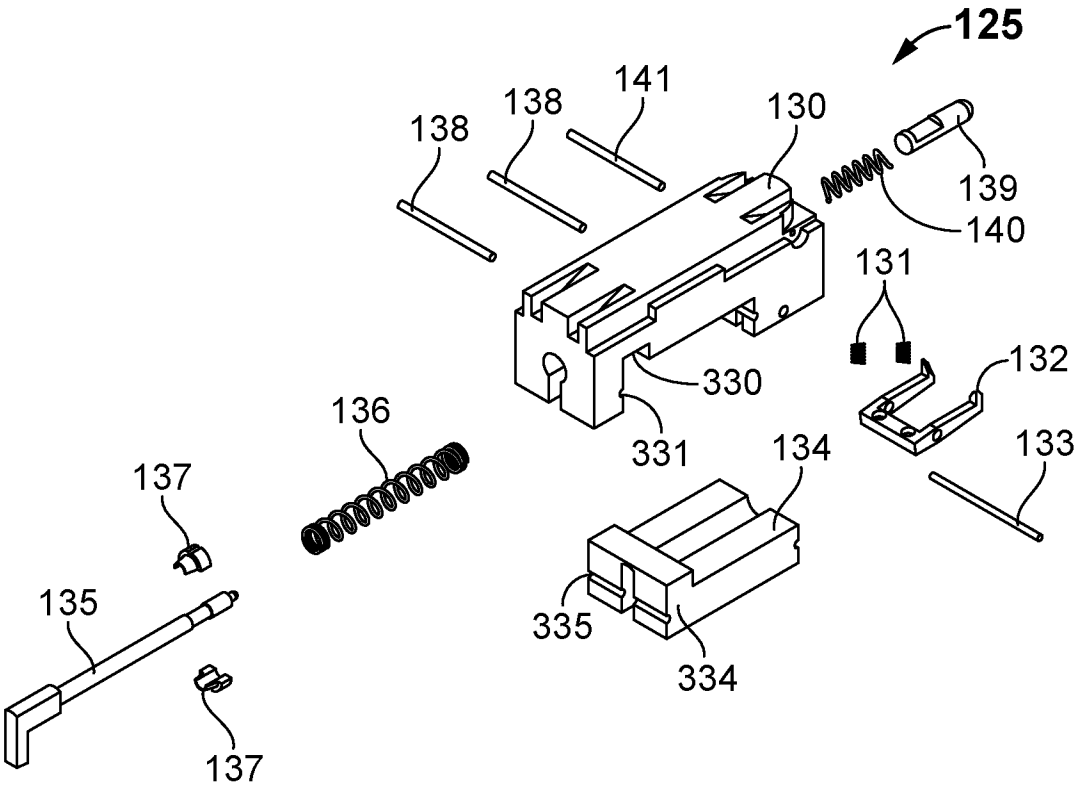
FIG. 4 depicts an exploded view of the bolt assembly of the present invention.

The receiver 101 also holds bolt stop 115 for the bolt assembly 125 (FIG. 4). The bolt stop 115 stops the forward motion of the bolt 130. The bolt stop 115 includes the bolt stop screw 116, the bolt stop pin 117, the bolt stop spring 118 and the bolt stop arm 119. The bolt stop screw 116 secures the bolt stop 115 to the receiver 101 and allows the bolt stop 115 to pivot. The bolt stop pin 117 pushes the bottom of the bolt stop 115 rearward under spring tension. The bolt stop spring 118 pushes on the bolt stop pin 117 to prevent accidental or premature engagement. The bolt stop pin 117 and bolt stop spring 118 are threaded into the receiver 101 with the hold open cap 119. The bolt stop arm 120 pushes the top of the bolt stop 115 rearward and that causes interference.

The receiver 101 has a left load wing 121 and a right load wing 122 at its base. The left load wing 121 and the right load wing 122 prevent ammunition from falling through the receiver and acts as a feed ramp while being flexible enough to allow an empty hull to pass through.

FIG. 4 shows the parts of the bolt assembly 125. The bolt assembly 125 is broadly composed of the bolt 130, the extractor 132, the striker 135, and the ejector 139.

The bolt 130 interfaces with operation rods 231 of the barrel assembly 225(FIG. 7), and when bolt 130 is pushed forward by the operation rods 231 it serves as an actuating body for load gate 102. The bolt 130 utilizes an extractor 132, which pulls the cartridge from the chamber. The extractor 132 Is kept in position by tension from extractor springs 131 and is held in place by safety/extractor pin 133. The extractor springs 131 set into the bottom of bolt 130 putting downward force on the rear portion of the extractor 132. The safety/extractor pin 133 secures the extractor 132 to the bolt 130 and allows the extractor 132 to pivot under spring tension.

The bolt assembly 125 includes striker 135. The striker 135 is positioned inside the striker tray 134 which is located or adjacent to the bottom of the bolt 130. The striker tray 134 has a striker guide or recess which corresponds to a guide or recess in bolt 130. The striker 135 is biased by striker spring 136. The striker tray 134 holds the striker 135 in position in the bottom of the bolt 130 with two puzzle box pins 138. The striker tray 134 has a raised upper edge 334 that fits into a recess 330 of bolt 130 and is held in place by the two puzzle box pins 138 being placed in between striker tray indent 335 and bolt indent 331 which connect to form a cylindrical opening for the puzzle box pins 138 to go through. The puzzle box pins 138 fix the striker tray 134 to the bolt 130. In a typical gun with a striker, the striker is manipulated directly by slide or by a receiver, whereas in the preferred embodiment of the present invention the striker 135 is manipulated by movement of the bolt 130. The striker spring 136 is in place around the striker 135 and held in place by two striker spring cups 137 that keep forward tension on the striker 135 via the striker spring 136. The striker 135 interacts with the sear 155 and the trigger bar 157 of the trigger assembly 145 (see FIG. 5) to disconnect and rest the trigger mechanism.

The bolt assembly 125 further includes an ejector 139, which ejects the spent shells downwards after they are fired. The ejector 139 sits in a cavity of the bolt 130 and compresses the ejector spring 140. The ejector spring 140 sits in the cavity of the bolt 130 behind the ejector 139 to provide tension to the ejector 139. The ejector 130 and ejector pin 140 are held in place by the ejector pin 141. The ejector pin 141 passes through the bolt 130 and interfaces with the scallop cut on the ejector 139 to retain the ejector 139 and the ejector spring 140.

Figure 5:
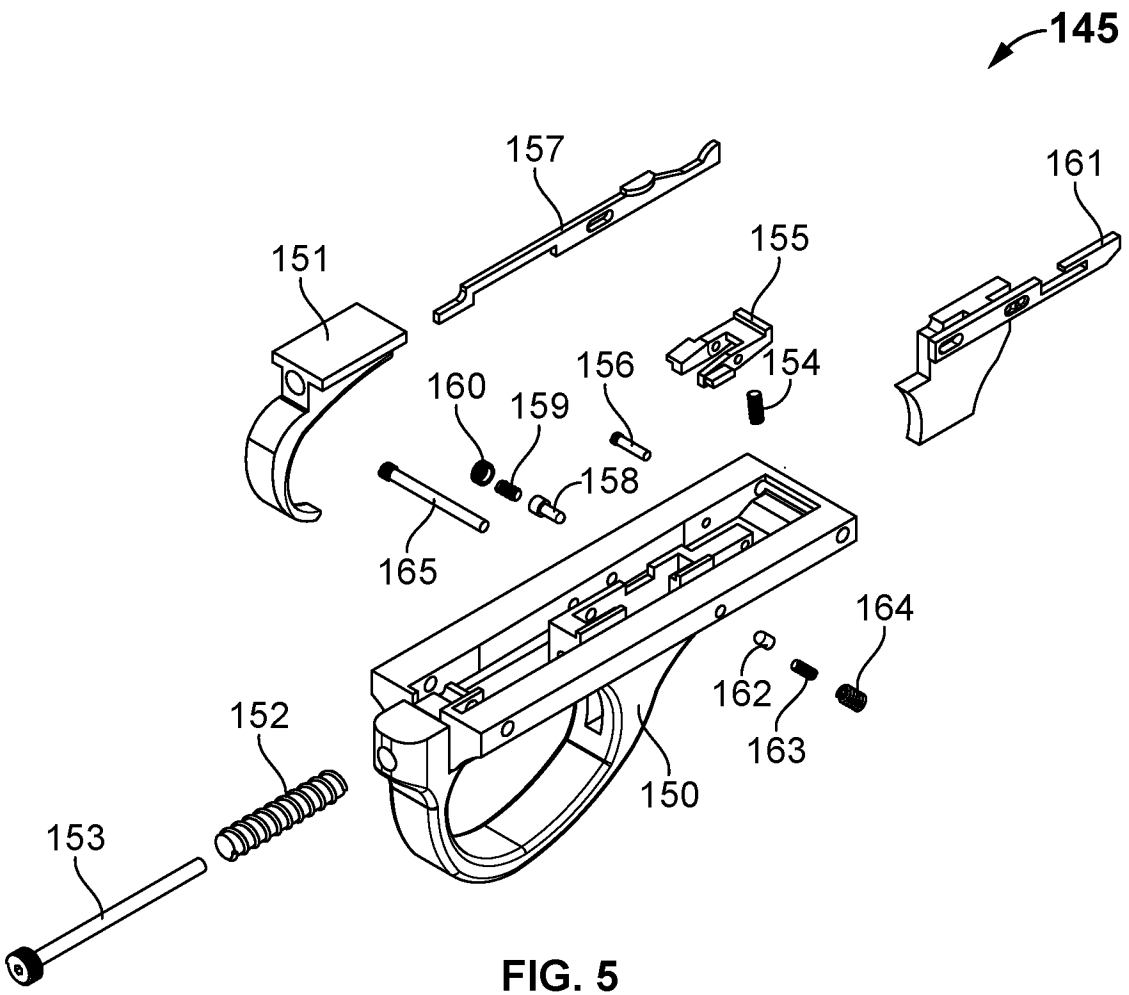
FIG. 5 depicts an exploded view of the trigger guard assembly of the present invention.

FIG. 5 depicts the trigger guard assembly 145. The trigger guard 150 houses the trigger 151, the sear 155, the trigger bar 157, the safety 161 and all associated springs, pins and other assembly parts. The trigger 151 sets in the trigger guard 150, interfaces with the trigger bar 157, and is kept under tension by trigger spring 152. The trigger spring 152 keeps forward tension on trigger 151 via the trigger guide screw pin 153 which threads into the trigger guard 150 from the rear of the trigger guard 150. The trigger bar 157 is also set in the trigger guard 150 and is held in place by safety pin 165 and interfaces with trigger 151. The trigger bar 157 has tension applied by trigger bar reset plunger 158. The trigger bar reset plunger 158 puts lateral tension on the trigger bar 157 and has tension applied by trigger bar reset plunger spring 159, which applies tension on trigger bar reset plunger 158 and is held in place by trigger bar reset plunger cap 160. The trigger bar reset plunger cap 160 applies tension to the trigger bar reset plunger spring 159 and retains the trigger bar reset plunger 158 and trigger bar reset plunger spring 159.

The sear 155 is set in the trigger guard 150 and held in place by sear pin 156 with upward tension on sear 155 being applied by the safety sear spring 154 which is also set in the trigger guard 150. The sear pin 156 acts as pivot for sear 155 as well as holding it in place in the trigger guard 150. The sear 155 interacts with striker 135 of the bolt assembly 125 (FIG. 4) and the safety 161.

The safety 161 is positioned in the trigger guard 150 and held in place by safety pin 165. The safety 161 has two positions: (1) fire; and (2) safe. The safety pin 165 is threaded into the trigger guard 150 and acts as guide and retains the trigger bar 157 and also guides and retains the safety 161. The safety 161 interacts with the sear 155 and the safety detent 162. The safety detent 162 interfaces in the groove of safety 161, and is under tension from the safety detent spring 163. The safety detent spring 163 puts lateral tension on the safety detent 162, and is held in place by the safety detent spring cap 164. The safety detent spring cap 164 threads into the trigger guard 150 and puts lateral pressure on the safety detent spring 163. The trigger guard 150 is affixed to receiver 101 by trigger guard retaining pins 166 (as shown in FIG. 3).

Figure 6:
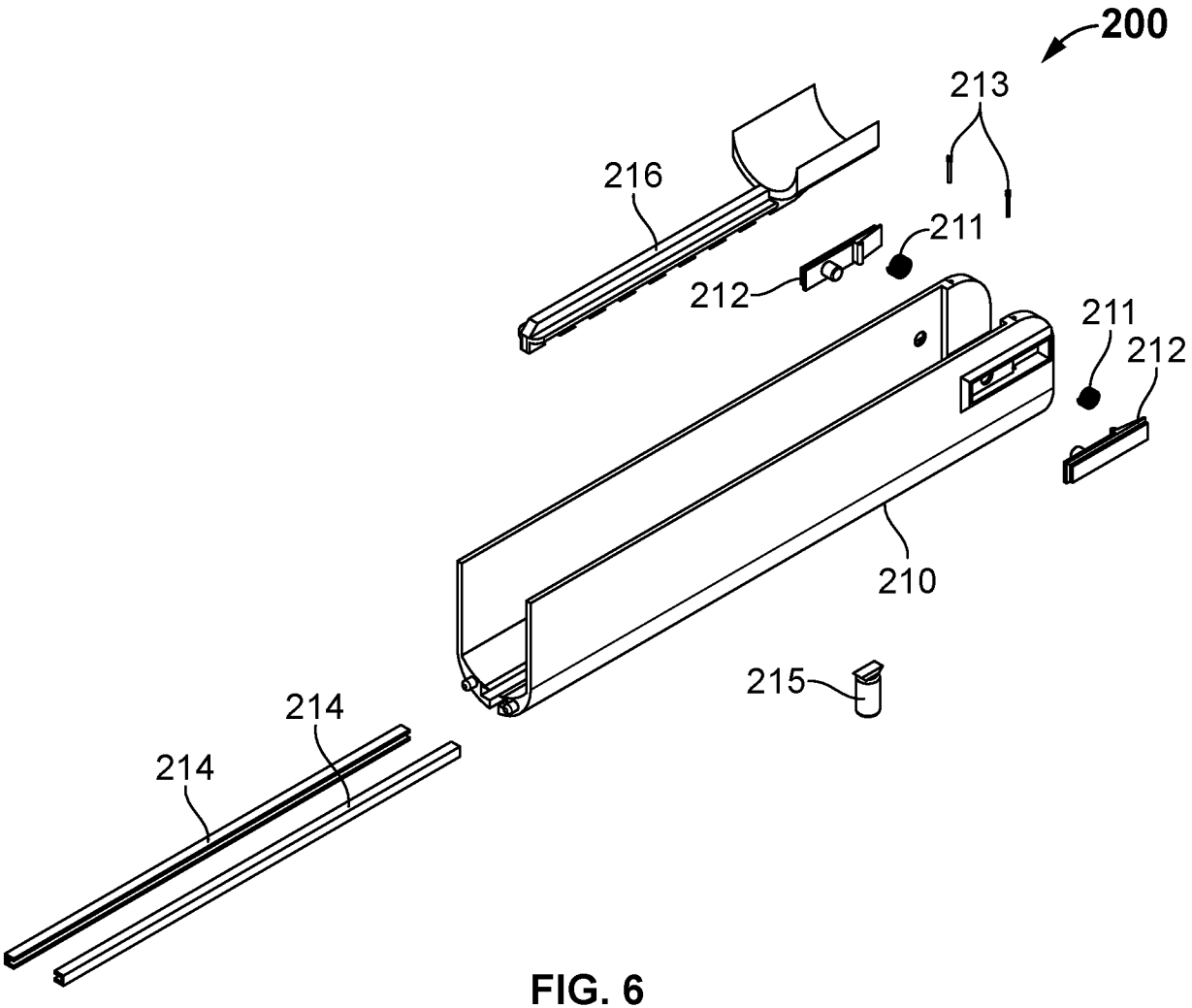
FIG. 6 depicts an exploded view of the handguard assembly of the present invention.

FIG. 6 depicts the handguard assembly 200. The handguard 210 houses the charging handle tracks 214 which are located in a lower portion. The tracks 214 serve as a guide and retainer track for charging handle 215. The charging handle track slides into the handguard 210 from the rear and are permanently affixed to the handguard 210. The charging handle 215 slides into dovetail cuts on the charging handle rod 216 and is retained by charging handle track 214, and servers as the actual user interface for the system to facilitate initial loading or unloading of the firearm. The charging handle rod 216 rides in track 214 and engages piston 230 (FIG. 7) to facilitate manual operation of action.

Figure 7:
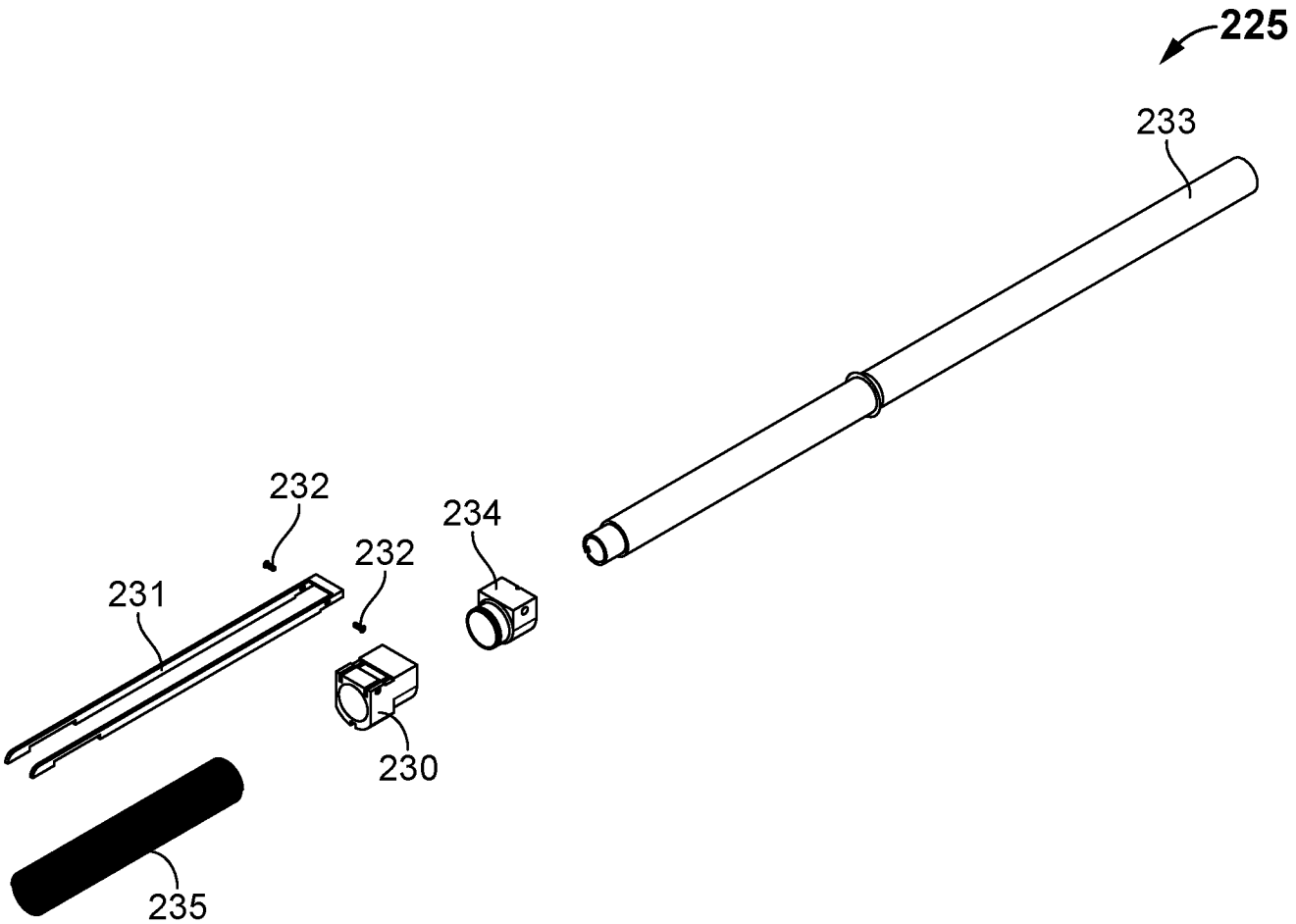
FIG. 7 depicts an exploded view of the barrel assembly of the present invention.

The handguard 210 also houses the handguard latch 211 and shields the piston 230 (FIG. 7) from interference while shielding the user from barrel 233 heat and gas vented by the gas block 234 (FIG. 7). The handguard 210 attaches to the receiver 101 via two locator pins and attaches to gas block 234 by spring loaded latches, handguard latch 212, on either side of the handguard 210. The handguard latch spring 211 puts outward pressure on the forward half of the handguard latch 212 to keep locking portion of latch locked with locking recesses on the gas block 234. The handguard latch 212 locks the handguard 210 to the gas block 234 and pivots on handguard latch screw pin 213. The handguard latch screw pin 213 joins the handguard latch 212 to the handguard 210 and allows it to pivot.

FIG. 7 depicts the barrel assembly 225. The barrel assembly is comprised of the piston 230, the operation rod 231, the operation rod screws 232, the barrel 233, the gas block 234 and the recoil spring 235. The piston 230 utilizes the gas from the gas block 234 to impact rearward force to the operation rod 231 which is connected to bolt 130. The operation rod 231 is forced toward the receiver 101 by the piston 230. The rearward motion of the operation rod 231 enables the locking block 105 to be raised allowing the bolt 130 to move rearward. Bolt 130 movement (rearward) then moves the load gate 102 to open and allow a new shell to enter the receiver 101 and then closes the load gate 102. The blot 130 then moves forward to chamber the shell and the bolt 130 is locked again by the locking block 105.

The operation rod 231 is secured to the piston 230 by the operation rods retainer screws 232. The barrel 233 directs shot downrange, houses the gas block 234, which is either integral to or fixed to the barrel 233 by threading or welding to barrel 233 and redirects propellant gases rearward into piston 230. The barrel 233 serves as a guide for the piston 230. The barrel 233 threads into the receiver 101 and also serves a guide for recoil spring 235. The recoil spring 235 is compressed by the piston 230 during rearward travel dampening shock and slowing bolt 130 speed. The recoil spring's 235 main function is to return bolt 130 to forward most position.

Figure 8:
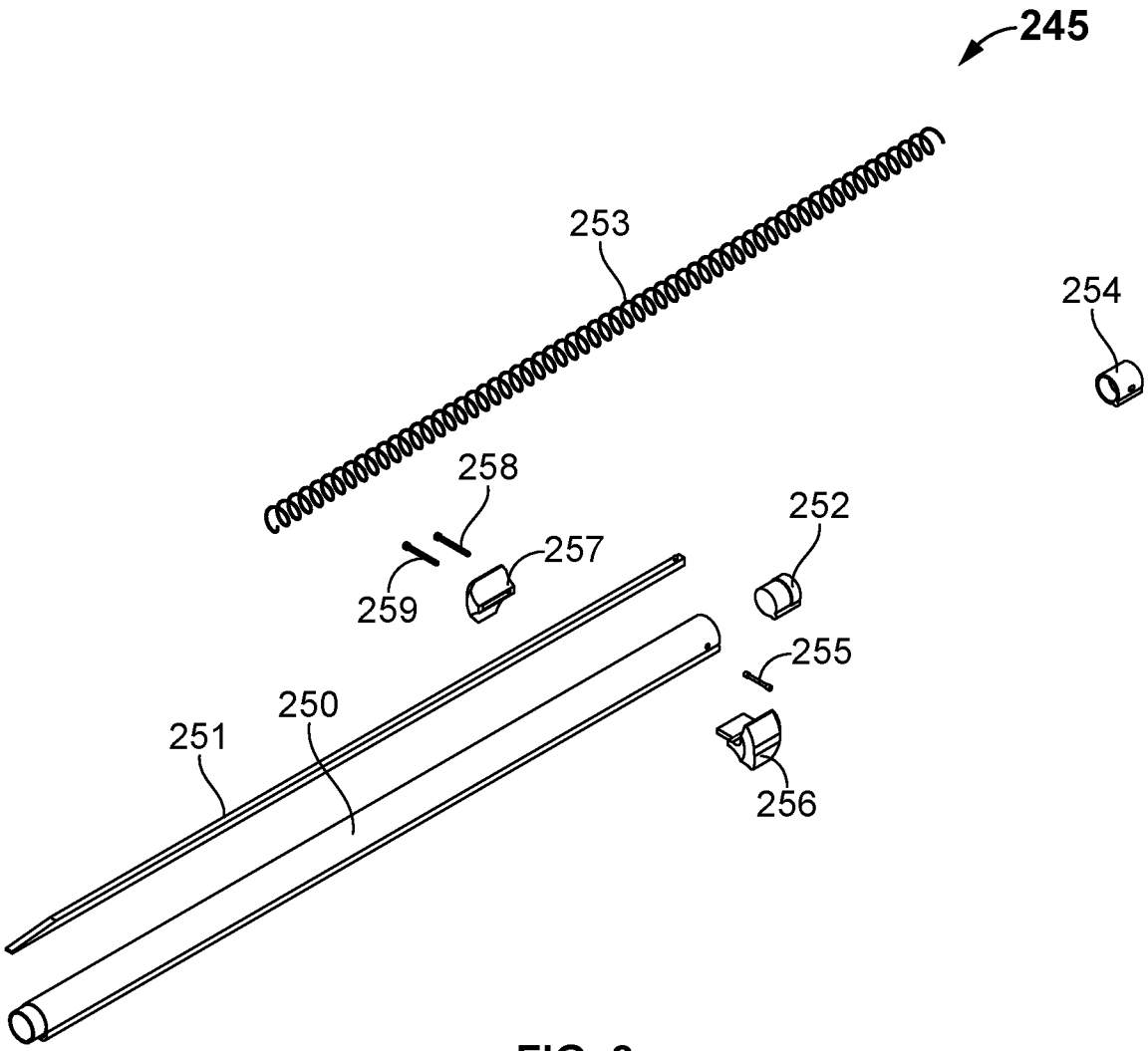
FIG. 8 depicts an exploded view of magazine tube assembly of the present invention.

FIG. 8 depicts the magazine tube assembly 245. The magazine tube 250 houses follower 252, magazine tube spring 253, magazine cap 254, and magazine cap pin 255. The magazine tube 250 houses ammo to be fed into receiver 101.

The vent rib 251 is permanently attached to the top of the magazine tube 250 and serves as a sight plane. The follower 252 loads into front of the magazine tube 250 and interfaces with bolt stop arm 120 (FIG. 3) and pushes it to the rear. The follower 252 is kept under tension by the magazine tube spring 253. The magazine tube spring 253 puts tension on the follower 252 and is captured in the magazine tube 250 by the magazine tube cap 254, which keeps tension on magazine tube spring 253 and loads into magazine tube 250 from the front and retained by the magazine tube cap pin. The magazine tube cap pin 255 is inserted into magazine tube 250 laterally through the side, also passing through the magazine tube cap 254, retaining the magazine tube cap 254 and allowing it to provide tension to the magazine tube spring 253. The magazine 250 is clamped using right side magazine tube clamp 256 and left side magazine tube clamp 257. The right side magazine tube clamp 256 pairs with the left side magazine tube clamp 257 and both parts are held together with two magazine clamp screws 258 that pass through the right side magazine tube claim 256 and screw into left side magazine tube clamp 257 to tighten the two pieces together. The assembled clamps 256 and 257 mates the magazine tube 250 to barrel 233 to prevent the magazine tube 250 from rotating or drooping when loaded.

Figure 9:
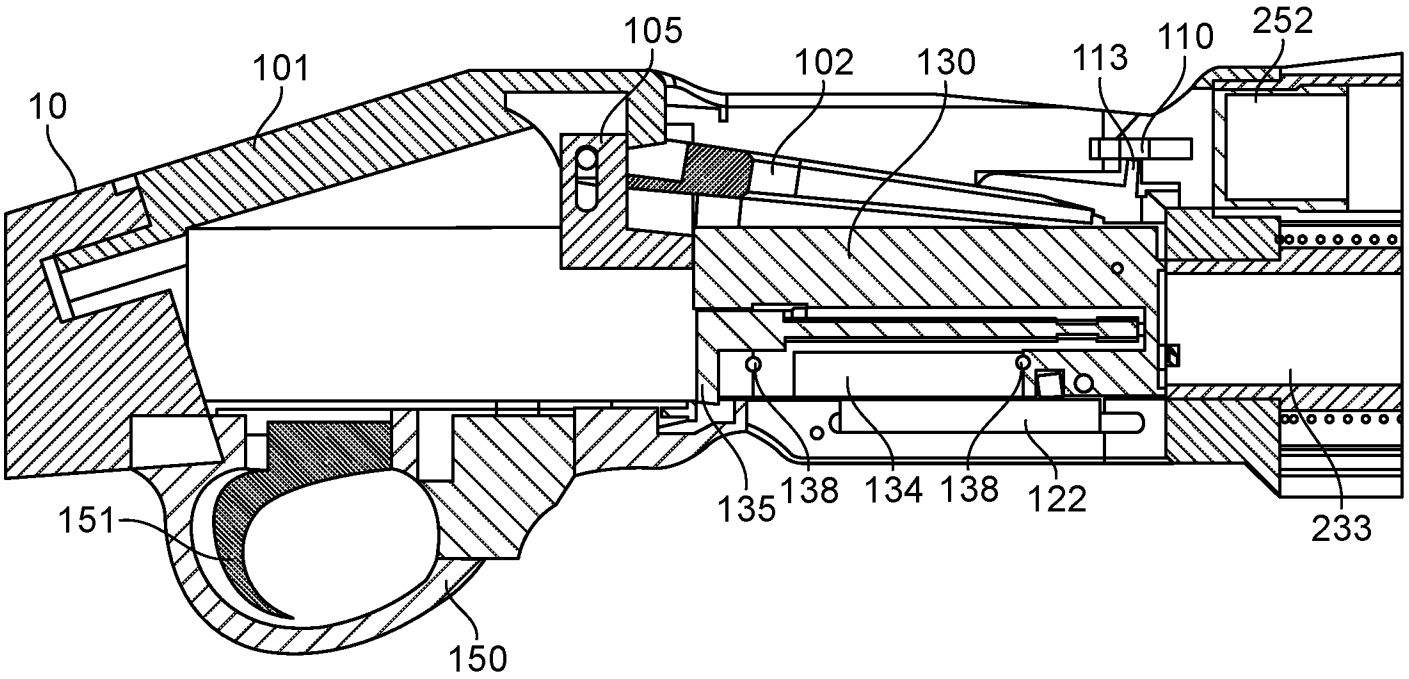
FIG. 9 depicts a cross sectional view of the present invention with an empty loading mechanism.

FIG. 9 shows a close up cross sectional view of the assembled semi-automatic shotgun receiver section, unloaded. The receiver 101 is connected rearwardly to the stock 10, is housing the trigger guard assembly and the bolt assembly, and is connected forwardly to the magazine assembly 245, barrel assembly 225, and handguard assembly 200. The receiver 101 holds the bolt 130 which has the load gate 102 resting on it. The load gate 102 is held in place by the shell stop 113, and the shell interrupter 110 is in the engaged position above the shell stop 113. The shell interrupter 110 is abutting the follower 252 in the magazine tube. The bolt 130 is locked into place by the locking block 105. The bolt 130 holds the striker 135 and the striker tray 134. The striker tray 134 is attached to the bolt by puzzle box pins 138. Underneath the striker box is the right load wing 122. The bolt 130 is abutted by the barrel 233. The receiver also holds the trigger guard 151, which holds the trigger 151.

Figure 10:
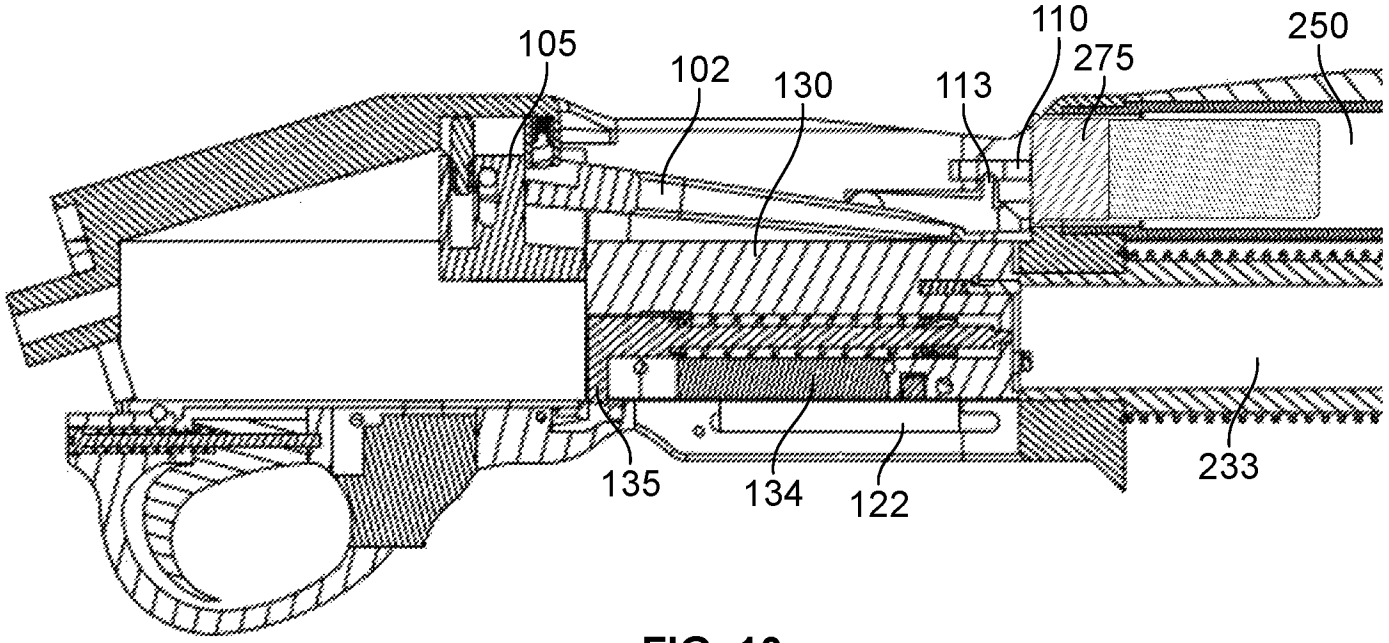
FIG. 10 depicts a cross sectional view of the present invention with a shell in the chamber prior to being loaded into the loading mechanism.

FIGS. 10 through 15 depict the movement or path of a shell through the semi-automatic shotgun of the present invention. FIG. 10 shows the cross sectional view of the assembled semi-automatic shotgun with a shell being loaded. The shell 275 is in the magazine tube 250. The shell stop 113 is stopping the shell from moving to the receiver 101 and chamber, and is engaged and applying downward force onto the load gate 102. The bolt 130, striker 135 and striker tray 134 are all in forward position, and the barrel 233 is empty and being blocked by the bolt 130.

Figure 11:
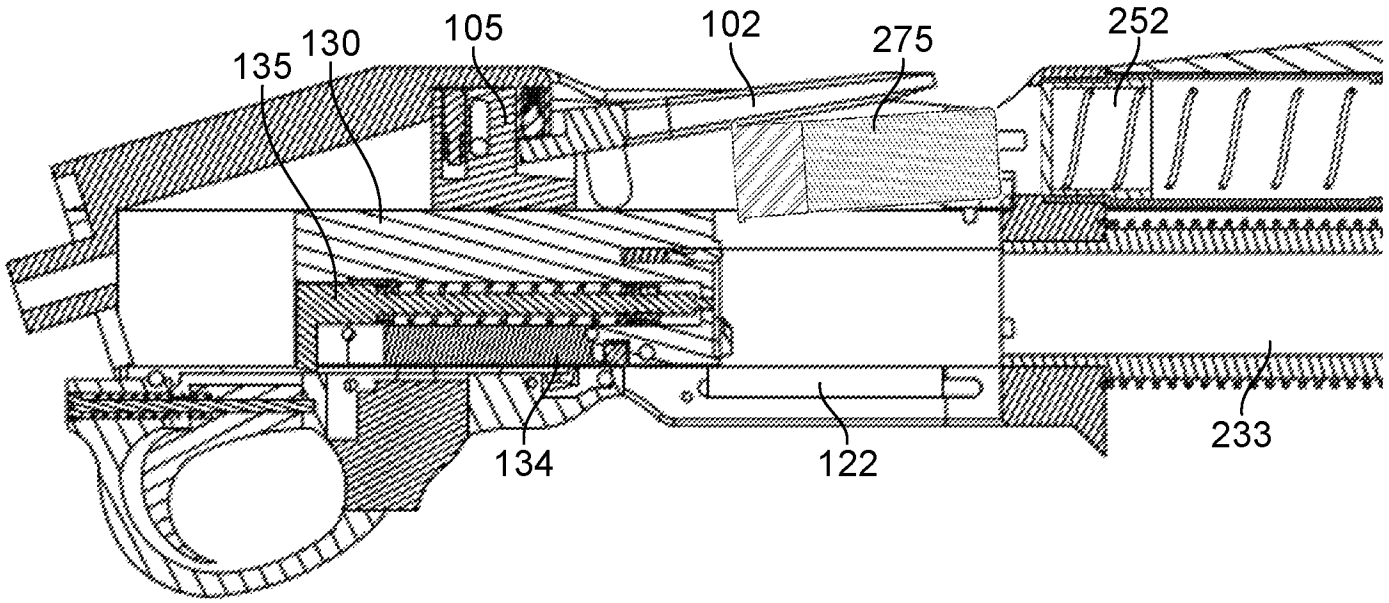
FIG. 11 depicts a cross sectional view of the present invention with a shell in the process of being loaded into the loading mechanism.

FIG. 11 shows the cross section view of the assembled semi-automatic shotgun with the shell 275 in a released position starting its travel to the rear and down, it is guided by the load gate 102. The load gate 102 is in upward position to guide the shell 274 down in line with the bolt 130, which has traveled to its rearmost position. If there were more shells 274 in the magazine tube, the shell interrupter 110 stops the next of the shell from following the first down into the chamber and allow the load gate 102 to return to its downward position. The locking block 105 is in the upward unlocked position to allow the bolt 130 to move rearward.

Figure 12:
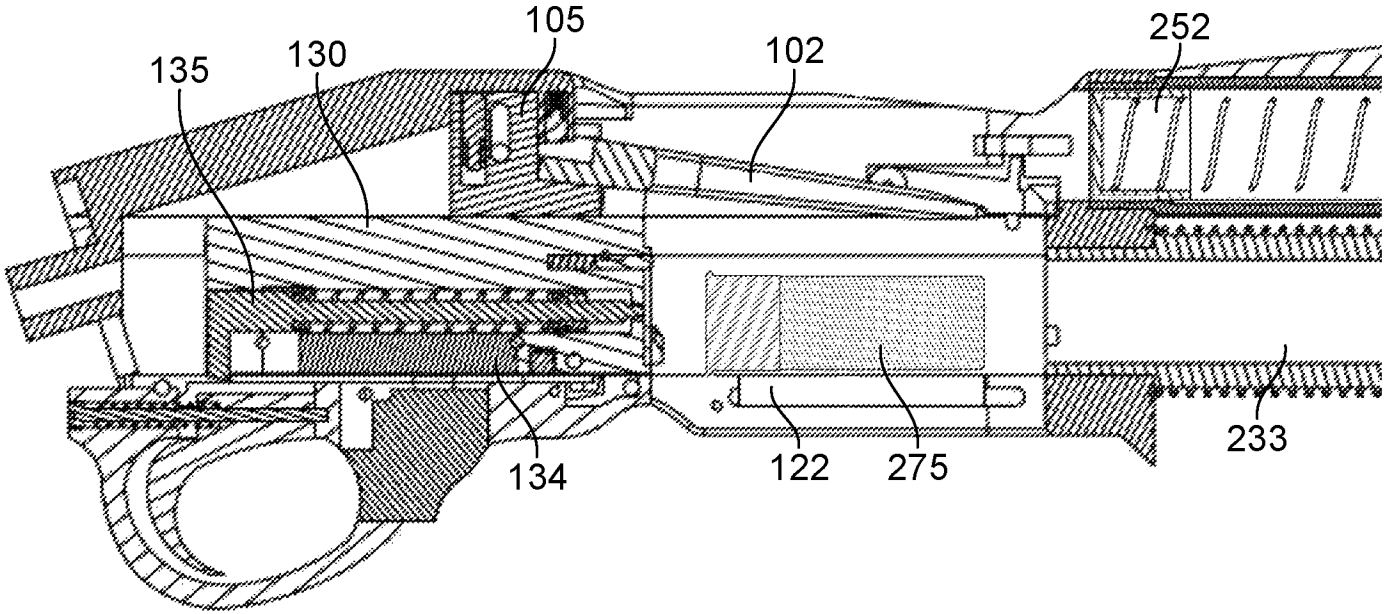
FIG. 12 depicts a cross sectional view of the present invention with the shell being loaded in the lower chamber of the loading mechanism.

FIG. 12 shows the cross section view of the assembled semi-automatic shotgun with the shell 275 resting on load wings 121 and 122 ready to be pushed forward into the chamber of the barrel 233 by the bolt 130, which is still in its rearmost position. The load gate 102 is in its downward most position, having guided the shell 275 into the battery. The locking block 105 is in the unlocked position allowing the bolt 130 to be in the rearmost position.

Figure 13:
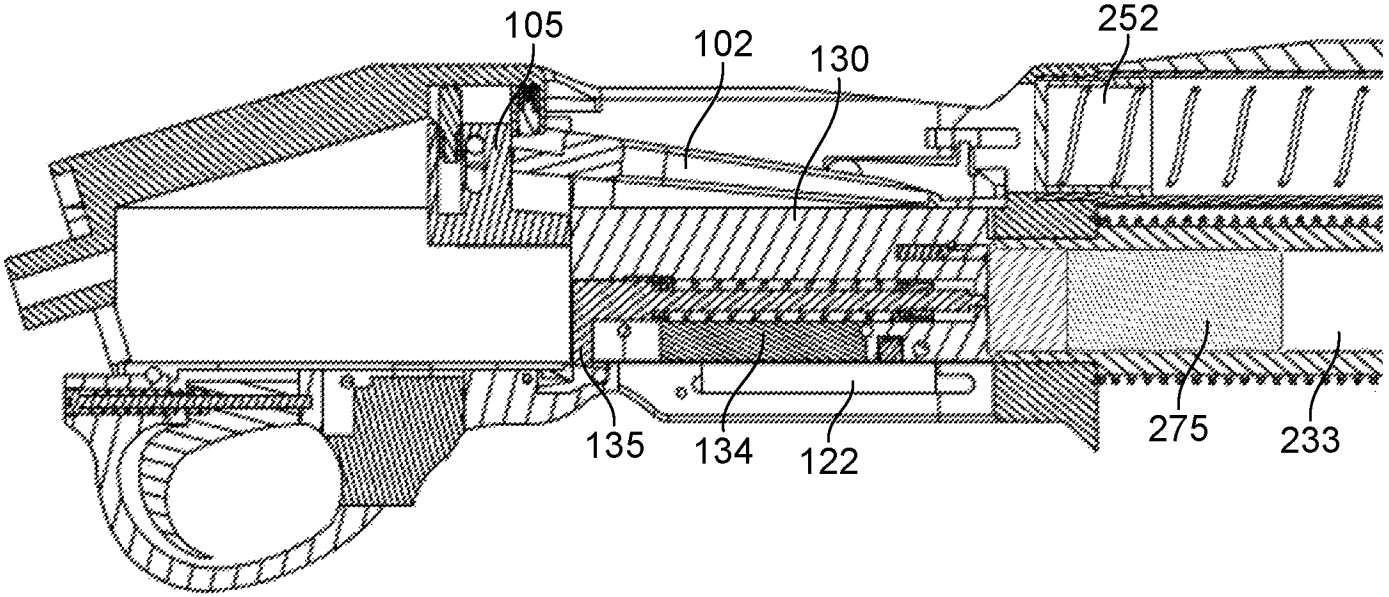
FIG. 13 depicts a cross sectional view of the present invention with a shell advanced into the firing chamber.

FIG. 13 shows the cross section view of the assembled semi-automatic shotgun with the shell 275 in the chamber of the barrel 233, with the bolt 130 engaged in the battery and held in locked position by locking block 105.

Figure 14:
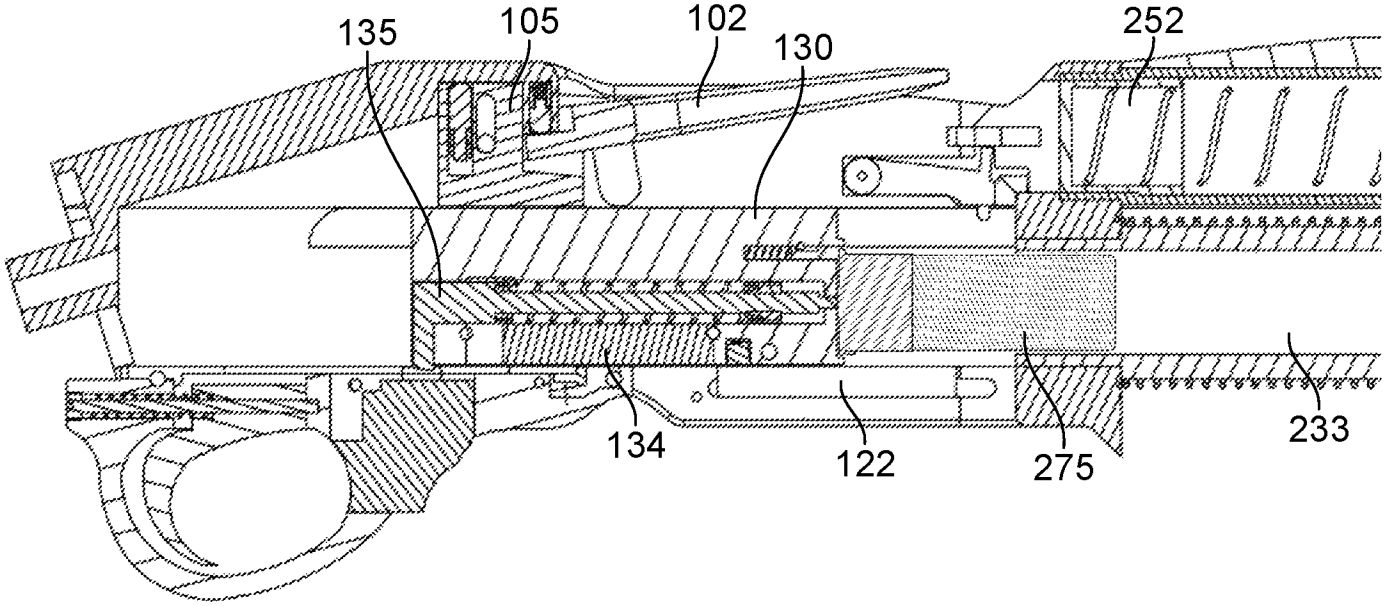
FIG. 14 depicts a cross sectional view of the present invention with the shell after firing and beginning ejection of the shell.

FIG. 14 shows the cross section view of the assembled semi-automatic shotgun with the shell 275 traveling backwards to be ejected. The bolt 130 is about halfway through its rearward travel, and the locking block 105 is in the unlocked position.

Figure 15:
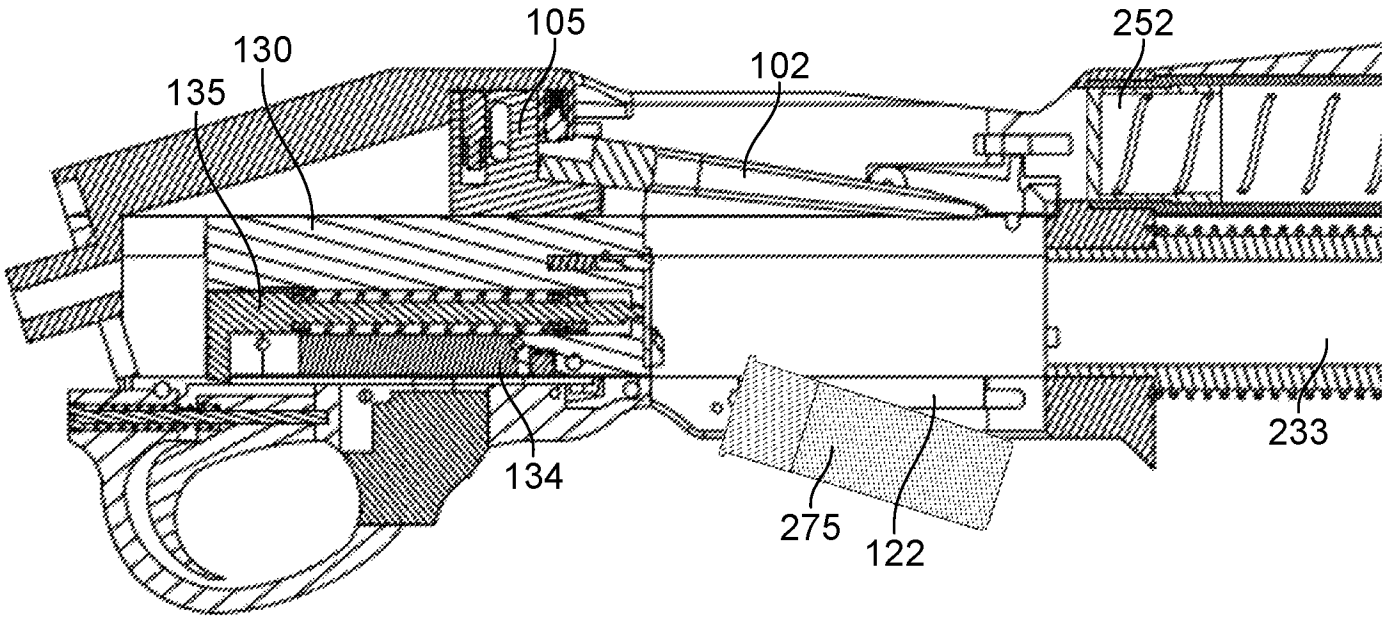
FIG. 15 depicts a cross sectional view of the present invention with the shell being ejected from the shotgun.

FIG. 15 shows the cross section view of the assembled semi-automatic shotgun with the shell 275 being ejected downward through the load wings 121 and 122. The bolt 130 is in it rearmost position and the locking block 105 is in the unlocked position.

FIGS. 16A-22 provide details of the movement of the locking block 105, bolt 130, and load gate 102 during a loading of the shotgun of the present invention.

Figure 16B:
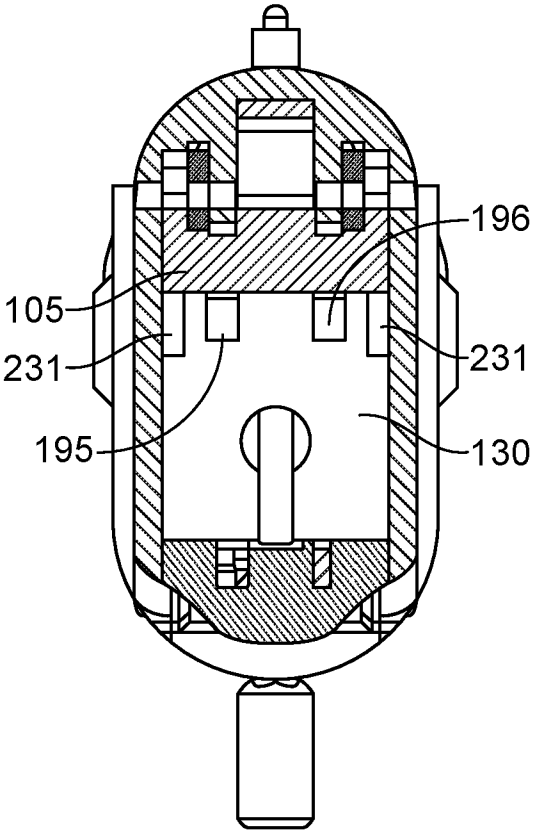
FIG. 16B depicts a cross sectional view of the present invention along the axis of the barrel through the locking block and bolt in an unlocked position.
Figure 16A:
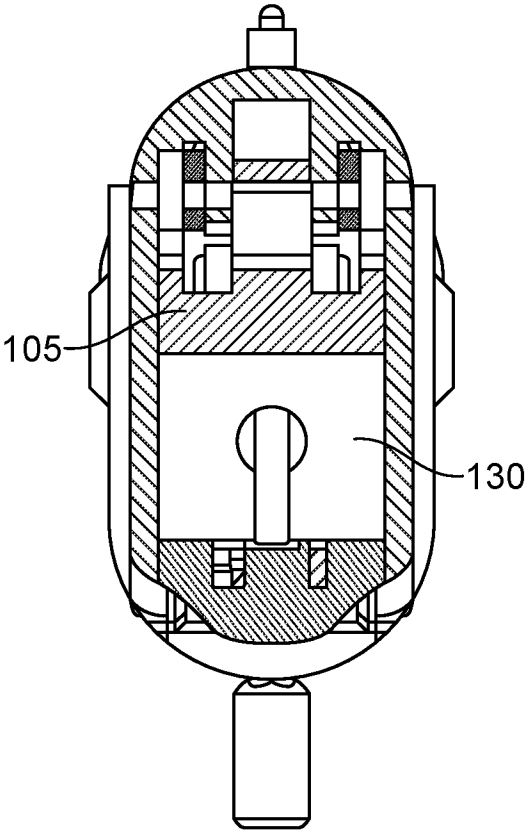
FIG. 16A depicts a cross sectional view of the present invention along the axis of the barrel through the locking block and bolt in a locked position.

FIGS. 16A and 16B provide a cross sectional view along the axis of the barrel through the locking block and bolt. In FIG. 16A, the locking block 105 is in a downward position and locking the bolt 130. In FIG. 16B, the locking block 105 has been moved upward by the arms of operation rod 231 placing the bolt 130 in an unlocked position. The bolt 130 has two rearward grooves, paths, or ramps 195, 196 for engaging one or more protrusions or legs 182 (see FIG. 17) of the load gate 102. As the bolt 130 is unlocked and able to move rearward, the legs 182 move along the ramps 195, 196 (as more clearly seen in FIGS. 17-22) to move the load gate 102.

Figure 17:
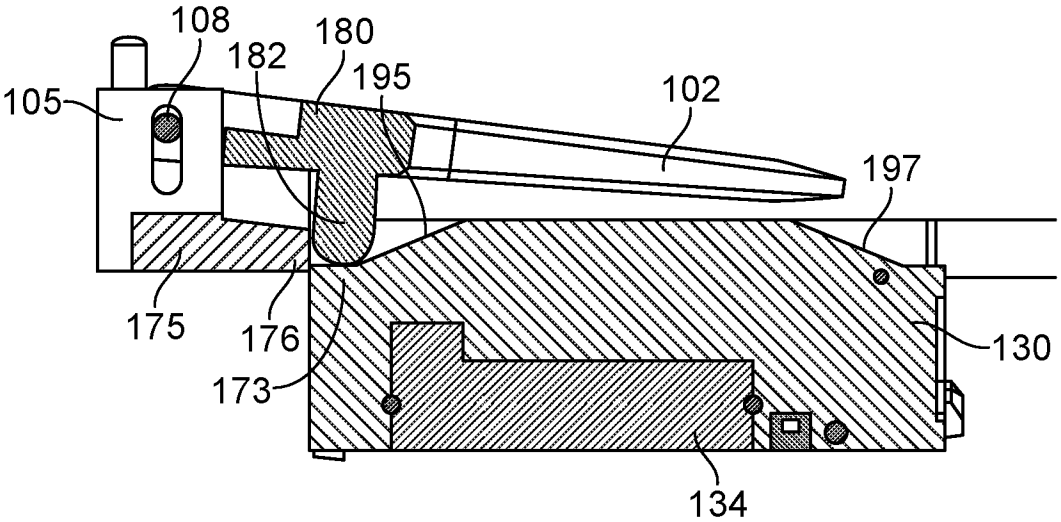
FIG. 17 depicts a cross sectional view of the present invention depicting the load gate and bolt interaction when the bolt is in a locked position.

As seen in FIG. 17, the load gate 102 is in a closed position as the locking block 105 is engaged with or has the bolt 130 in a locked position. The load gate 102 has a rearward portion 180 having legs or protrusions 182. The load gate 102 is connected to the locking block by pin 108 which rests in a guided slot in the locking block 106. The locking block has a lower portion 175 with a locking edge 176 which engages the bolt 130 at a rearward bolt edge 173. The bolt 130 has rearward ramps 195, 196 (not shown) and forward ramps 197, 198 (not shown).

Figure 18:
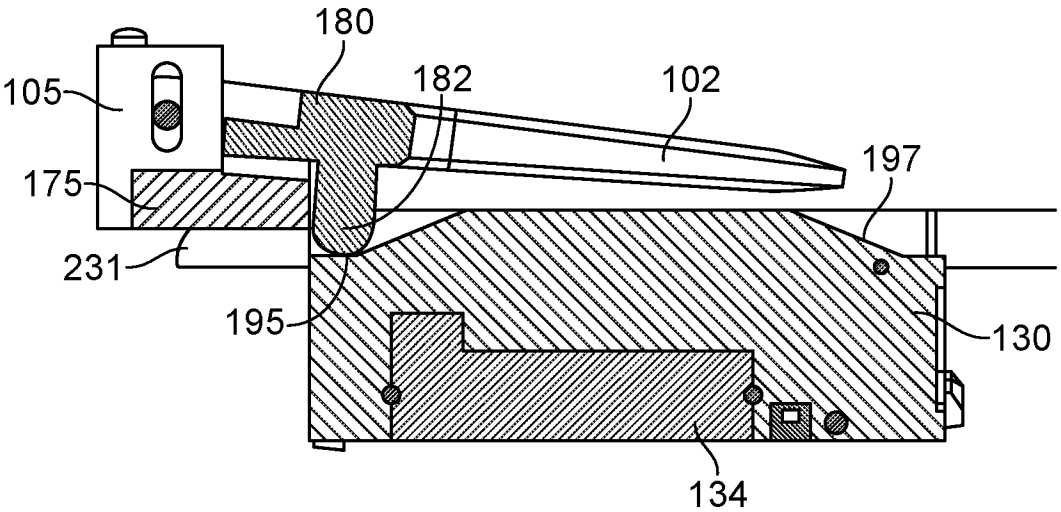
FIG. 18 depicts a cross sectional view of the present invention depicting the load gate and bolt interaction when the bolt is in an unlocked position.
Figure 19:
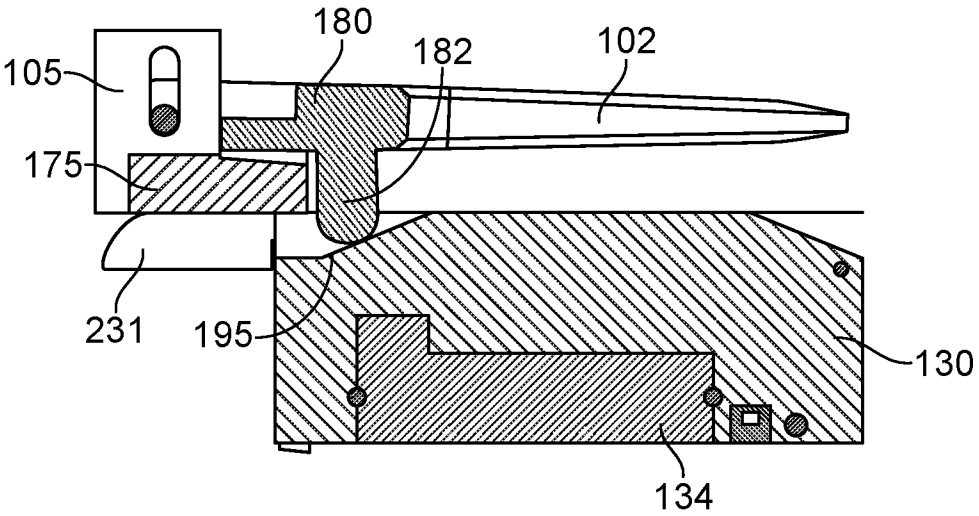
FIG. 19 depicts a cross sectional view of the present invention depicting the load gate and bolt interaction when the load gate rises.
Figure 20:
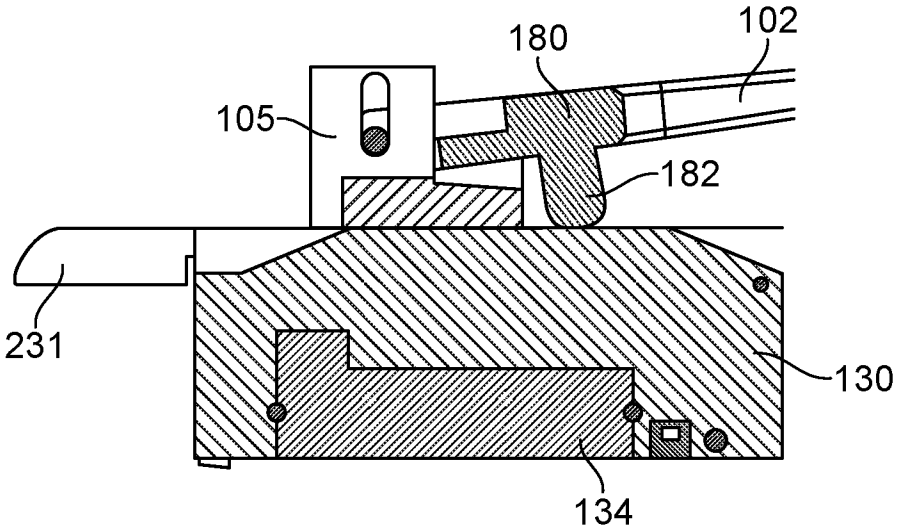
FIG. 20 depicts a cross sectional view of the present invention depicting the load gate and bolt interaction when the load gate is in an open position.
Figure 21:
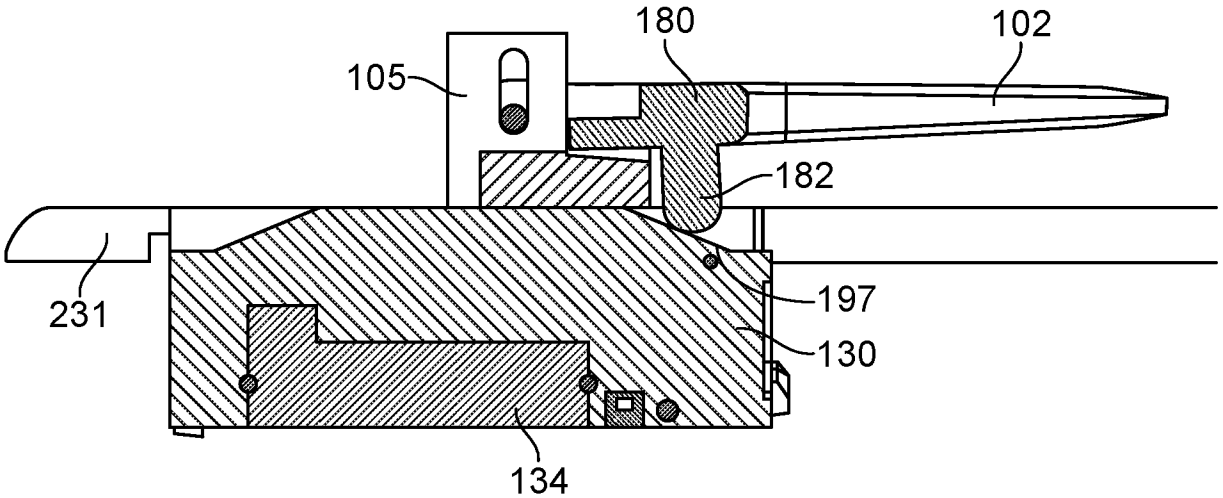
FIG. 21 depicts a cross sectional view of the present invention depicting the load gate and bolt interaction when the load gate beings to lower.
Figure 22:
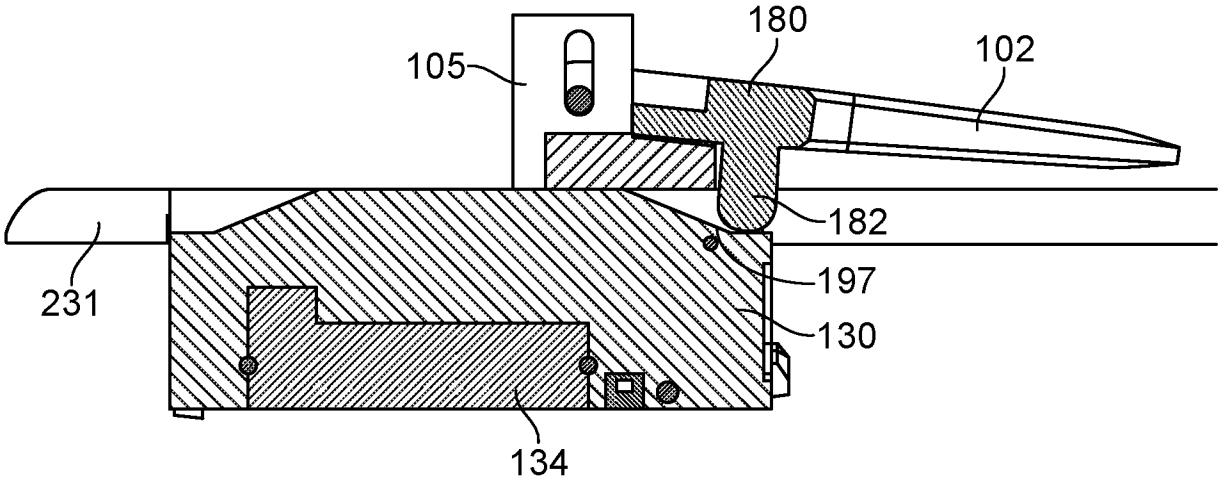
FIG. 22 depicts a cross sectional view of the present invention depicting the load gate and bolt interaction when the load gate is fully lowered for firing.

In FIG. 18, the arms of the operation rod 231 have raised the locking block 105 by raising the lower portion 175 of the locking block 105. As the locking block 105 has been raised, the bolt 130 is able to move in a reward position. As seen in FIG. 19, as the bolt 130 moves rearward, the legs or protrusions 182 of the load gate 102 begin to move along the ramps 195, 196 of the bolt 130. As seen in FIG. 20, the legs 182 of the load gate 102 are fully raised on top of the bolt 130. This relates to the open position of load gate 102 allowing a shell to enter the receiver 101. As seen in FIG. 21, the legs 182 of the load gate 102 begin to move down the forward ramps 197 of the bolt 130 to lower the gate 102 and subsequently the shell into the receiver 101. In FIG. 22, the load gate 102 is fully lowered and the shell is now in the receiver.

The bolt 130 would then move forward again which would both chamber the shell and move the bolt 130 back into a locked position by the locking block 105 returning to its locking position (FIG. 16A and FIG. 17). The present invention provides a unique method for locking block 105, load gate 102, and bolt 130 movement and mechanical engagement through design of the bolt 130, bolt ramps 195, 196, 197, 198, and the load gate legs 182. This design enables a semi-automatic shotgun top loading configuration with improved efficiencies in loading, firing, and spent shell ejection.

In an exemplary embodiment, the present invention provides a one-piece extractor with duel engagement points or extractor claws. The duel engagement points are configured to allow the shell's primer striking the extractor and provide a more positive extraction of the spent shell from the chamber. Another aspect of the present invention is the load wings which may be made of a rigid material, a flexible solid material, or may be made of a metal and tensioned inward by a spring pressure.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention

What is claimed is:

1. A shotgun, the shotgun comprising:

a barrel defining a longitudinal axis and an axially extending bore forming a projectile pathway;

a receiver supporting the barrel;

an elongated magazine positioned above the barrel and extending axially forward from the receiver, the magazine including an axially extending cavity configured to receive a plurality of ammunition shells in stacked end-to-end relationship, the shells each having a head and diametrically enlarged rim; a top loading port for loading shells into the magazine, a bolt with at least one guide path, wherein the at least one guide path has at least one design; and a load gate having at least one protrusion, wherein the at least one protrusion moves along the at least one guide path causing the load gate to open and close based on the at least one design in the path, wherein as the bolt moves in a first direction the load gate rises to allow a shell from the magazine to enter the receiver.

2. The shotgun of claim 1, wherein the design of the at least one guide path is a descending ramp.

3. The shotgun of claim 1, wherein the design of the at least one guide path is an ascending ramp.

4. The shotgun of claim 1, wherein the at least one design includes an ascending ramp and a descending ramp.

5. The shotgun of claim 1, wherein the at least one guide path comprises a first guide path and a second guide path.

6. The shotgun of claim 5, wherein the at least one protrusion comprises a first protrusion for moving along the first guide path and a second protrusion for moving along the second guide path.

7. The shotgun of claim 1, further comprising a locking block for preventing movement of the bolt in the first direction when locked.

8. The shotgun of claim 7, wherein the locking block is unlocked by an operation rod.

9. The shotgun of claim 1, further comprising a striker for striking a shell in the barrel.

10. A shotgun, the shotgun comprising:

a barrel defining a longitudinal axis and an axially extending bore forming a projectile pathway;

a receiver supporting the barrel;

an elongated magazine positioned above the barrel and extending axially forward from the receiver;

the magazine including an axially extending cavity configured to receive a plurality of ammunition shells in stacked end-to-end relationship, the shells each having a head and diametrically enlarged rim; a top loading port for loading shells into the magazine;

a bolt having a first guide path and a second guide path, wherein the first guide path and the second guide path have an ascending ramp and a descending ramp;

a load gate having a first protrusion and a second protrusion on a lower portion of the load gate, wherein the first protrusion moves along the first guide path and the second protrusion moves along the second guide path;

wherein as the bolt moves in a first direction the load gate rises as the first protrusion and second protrusion ascend up the ascending ramp to allow a shell from the magazine to enter the receiver and the load gate closes as the first protrusion and second protrusion descend down the descending ramp.

11. The shotgun of claim 10, the system further comprising a locking block for preventing movement of the bolt in the first direction when locked.

12. The shotgun of claim 11, wherein the locking block is unlocked by an operation rod.

13. The shotgun of claim 10, further comprising a striker for striking a shell in the barrel.

* * * * *